United States Patent [19]

Halberstadt

[11] Patent Number: 4,717,517

[45] Date of Patent: Jan. 5, 1988

[54] CONCURRENT METHOD OF BUILDING CONSTRUCTION AND FORMWORK STRUCTURE THEREFORE

[76] Inventor: Alex E. Halberstadt, 104 Crandon Blvd., Key Biscayne, Fla. 33149

[21] Appl. No.: 407,756

[22] Filed: Aug. 13, 1982

[51] Int. Cl.[4] ..... B22D 19/04; E04B 1/16; E04G 11/02; E04G 17/06

[52] U.S. Cl. ..... 264/33; 249/21; 249/27; 249/47; 249/48; 249/83; 249/193; 249/194; 249/219 R; 264/34; 264/35

[58] Field of Search ..... 264/33, 34, 35; 249/20, 249/21, 27, 47, 48, 83, 193, 194, 219 R; 425/63, 64, 65

[56] References Cited

U.S. PATENT DOCUMENTS

| | | | |
|---|---|---|---|
| 1,630,794 | 5/1927 | Keller | 425/63 |
| 2,705,359 | 4/1955 | Strandberg | 249/20 |
| 3,037,259 | 6/1962 | Dave | 425/63 |
| 3,182,374 | 5/1965 | Cook | 249/20 |
| 4,249,870 | 2/1981 | Krabbe et al. | 264/33 |

*Primary Examiner*—Jan H. Silbaugh
*Assistant Examiner*—Karen D. Kutach
*Attorney, Agent, or Firm*—Pasquale A. Razzano

[57] ABSTRACT

A multi-story concrete building is constructed concurrently, that is, the steps for constructing the same are carried out simultaneously on different respective stories. To achieve this end, vertical formwork members for forming the columns and bearing walls for one story are erected. Then decking formwork is erected for forming a concrete slab to serve as the floor for the next story thereabove. Formwork spacers are affixed to the tops of the vertical formwork members and these spacers provide mounts, extending through the thickness of the slab to be formed, for mounting the vertical formwork members for the next story. The vertical formwork members for the next story are then erected. Fresh concrete is poured into at least the vertical fromwork members and is permitted to cure and solidify into the vertical support members for that story. Other formwork members are erected above the next story while concrete is concurrently poured and formwork is stripped on different respective stories. The form spacers can, e.g., be channel members or, alternatively, closed-end angle members.

15 Claims, 10 Drawing Figures

CONCURRENT METHOD OF BUILDING CONSTRUCTION AND FORMWORK STRUCTURE THEREFORE

BACKGROUND OF THE INVENTION

1. Field of the Invention

This invention relates to the construction of poured-in-place concrete structures, and is particularly directed to a method of concurrently carrying out the several steps of erecting formwork, laying in reinforcement, pouring fresh concrete into the formwork, curing the concrete members so formed, and stripping the formwork from the cured concrete members. Phrased otherwise, this invention is directed to a method of construction in which formwork is erected for several stories above the last completed story of the building under construction, so that the various steps mentioned above can be carried out concurrently on different respective stories, thereby effecting savings in workman waiting time and in total building erection time.

2. Brief Description of the Prior Art

Conventional cast-in-place construction of a typical concrete multi-story building requires that the slab for each floor level be formed and poured before formwork for the vertical structural members (i.e., columns and bearing walls) leading to the next floor level can be erected, and thereby creates timing conflicts and delay periods among the various tasks involved. For example, in a standard eight-day cycle (i.e., eight working days being required for each story) concrete is poured only two days of the eight (one day for the floor slabs, one day for the walls and columns). By the very nature of the standard method, workmen such as electricians, plumbers, and cement finishers are continually interrupted. Consequently the standard method of construction is rather inefficient and leaves considerable room for improvement. Nonetheless, no suitable method for improving the efficiency of construction has previously been offered.

In the conventional method of constructing a reinforced concrete high rise building (indeed in any known method), the speed with which one floor cycle is completed depends on the quantity of forms used, the complexity of the building structure, the availability of manpower, the number of hours worked, the coordination and cooperation of the tradesmen and subcontractors involved, the contractor's scheduling process, weather, the owner's requirements, inspection time, and curing time of the concrete.

These conditions impose themselves upon a structure and dictate its speed of construction. For example, if it takes eight working hours to erect a slab form for a particular building, that is the minimum amount of time which must be devoted to that step. The sum of the times required for the various steps of the construction method dictates the floor-to-floor cycle time, taking into consideration normal overlap of some operations. One example of overlap is that conduit can be placed at one end of one story of a building while the bottom reinforcement steel is still being placed in other areas of that same story. This overlapping is standard procedure with time-oriented building contractors and is a prime consideration in scheduling.

All known construction methods require placing the column steel reinforcement and column formwork for each floor only after concrete for the next prior floor has been poured. This is the traditional beginning point for the next cycle and is the standard method of construction for a poured-in-place reinforced concrete structure. Regardless of the speed of the floor-to-floor cycle, the sequence remains the same.

Depending on the complexity of the structure for a given building, the performance of all the work necessary for one floor-to-floor cycle consumes from three to ten days. For the work required for the construction to progress one story (e.g., from the fourth floor to the fifth floor of a building), the sequence of steps is generally as outlined:

Step No. 1—Pour slab (assume 4th floor).
Step No. 2—Install vertical reinforcing steel.
Step No. 3—Erect formwork for columns and walls to 5th floor.
Step No. 4—Pour columns and walls.
Step No. 5—Strip vertical formwork.
Step No. 6—Erect deck formwork for 5th floor slab.
Step No. 7—Place reinforcing steel and conduits.
Step No. 8—Pour 5th floor slab (Step No. 3 is sometimes combined with this step).

Typically these steps could fall on calendar days as follows:

Friday, Step No. 1;
Monday, Steps No. 2, 3, and 4;
Tuesday, Step No. 5 and 6;
Wednesday, Step No. 7;
Thursday, Step No. 8;

This constitutes what is known as a four-day cycle, which is considered to be the standard of good practice.

In this conventional method, at any one time there is formed only the next slab to be poured, other than the formed slabs curing below. Up to three full slab forms are used for a building, depending on the curing time required prior to stripping or removal of the slab form, and also depending on the speed desired during construction.

In the standard conventional method, deck forms are never installed above unpoured slabs, and any column forms are erected only for the columns rising directly to the next floor slab to be poured, and never for any stories above that floor.

Further, field engineering crews are required to lay out the decking formwork for each slab to compensate for elevational errors in the slab therebelow. In a normal slab, these elevational differences are typically $\frac{1}{4}$ inch. It is necessary for these crews to do layout work on each freshly poured slab and also to lay out column alignments and level the decking formwork. Thus, two engineering work elements are required per slab. Without releveling of the slab forms by the field engineering crews, the variances would accumulate, and the top stories of a high-rise building could be unintentionally offset from their design height by several inches.

Desirably, in order to erect formwork several stories above an unpoured floor slab, some means would be required to ensure that the poured slabs for each story would automatically be adjusted to the proper elevation. Also, some means would be necessary to control the formwork dimensional layout. However, no such means has been available. Further, it has never been previously proposed to erect formwork over an unpoured slab.

OBJECTS AND SUMMARY OF THE INVENTION

Accordingly, it is an object of this invention to provide a concurrent method of constructing a poured-in-place, multi-story concrete building in which tradesmen and subcontractors can carry on work each day on different respective stories of the building, so that the building can be erected in a faster, more efficient fashion than with conventional construction practice.

It is a more specific object of this invention to provide a method in which formwork can be erected for several stories above the highest previously formed story, so that form workers, iron workers, plumbers and electricians, concrete workers, and cement finishers can perform the same respective jobs each day without interfering with one another.

It is another object of this invention to provide formwork structure that will enable such concurrent construction to be carried out, yet will ensure that the floor slab for each story will automatically be positioned at a correct level, notwithstanding the usual ¼ inch variations which may occur in the slabs of lower stories.

In accordance with an aspect of this invention, a method of constructing a multi-story building made of poured-in-place concrete involves, for each such story thereof, pouring a concrete slab constituting a floor thereof and vertical support members supporting a concrete slab constituting the floor for the next story thereabove, with the vertical support members for each such story being substantially in vertical alignment with the corresponding support members of the next story therebeneath. In this method, vertical formwork members for forming the vertical support members for one such story are erected. Then, decking formwork is erected for forming the concrete slab of the next story thereabove. Formwork spacers are affixed to the top of the vertical formwork members and these spacers provide mounts, extending through the thickness of the slab to be formed in the decking formwork, for mounting vertical formwork members for the next story. Once these spacers are in place, the vertical formwork members for the next story are erected. Fresh concrete is poured at least into the vertical formwork members of the one story and is permitted to solidify and thereby to become the vertical formwork members for that story. The concrete vertical support members are permitted to cure, and the concrete slabs and vertical support members for the next story thereabove are respectively poured and cured. Then the vertical formwork members are stripped from the cured vertical support members and the decking formwork is stripped from the cured concrete slabs.

With the method of this invention, formwork members can be installed for a plurality of successive stories such that, at one given time, for the plurality of successive stories, the formwork is stripped from the vertical concrete support members for a lowest story thereof, the concrete is curing in a story thereabove, the concrete is poured for the next story above that, reinforcing members are laid in place in the formwork for the story next above that story, and the formwork members are erected for yet another story. In other words, the various steps of the method of constructing are carried out concurrently.

The step of affixing the formwork spacers permits the vertical and decking formwork to be properly positioned independently of the final, settled position of any floor slabs in previous stories. These formwork spacers can be favorably formed as channel members having mounting apertures therein for securing to apertures in the vertical formwork members, or can alternatively be formed as closed-end angle members. In either case, the formwork spacers can be permitted to remain in place extending through the floor slab. These spacers serve to gauge the accurate placement of vertical column- and wallform members.

The above and other objects, features, and advantages of this invention will be more fully understood from a consideration of the ensuing description of a preferred embodiment, which is to be read in conjunction with the accompanying drawings.

DETAILED DESCRIPTION OF A PREFERRED EMBODIMENT

In the method of construction according to this invention, vertical formwork, or falsework for forming columns and bearing walls of a building are erected and continue, for example, up to four floors above the last-poured concrete slab. Thus, prior to casting or pouring of the next slab, support is provided for up to three further slab forms. The various construction tasks can therefore be performed at the same time on different respective floor levels.

By way of example, the various construction steps can be carried out on the following work days (for the sake of this example, it is assumed that the third floor slab has already been cast):

A. Monday: cast fourth floor slab; cast columns and walls to fifth floor; lay-in reinforcing steel and conduit for fifth floor slab; place slab form for sixth-floor slab; and erect formwork for columns and walls to seventh floor.

B. Tuesday: cast fifth floor slab; lay-in reinforcing steel and conduit for sixth floor slab; place slab form for seventh-floor slab; erect formwork for columns and walls to eighth floor.

C. Wednesday: cast sixth floor slab; cast columns and walls to seventh floor; lay-in reinforcing steel and conduit for seventh floor slab; place slab form for eighth-floor slab; and erect formwork for columns and walls to ninth floor.

D. Thursday: cast seventh floor slab; cast columns and walls to eighth floor; lay-in reinforcing steel and conduit for eighth floor slab; place slab form for ninth-floor slab; and erect formwork for columns and walls to tenth floor.

E. Friday: cast eighth floor slab; cast columns and walls to ninth floor; lay-in reinforcing steel and conduit in ninth floor slab; place slab form for tenth-floor slab; amd erect formwork for columns and walls to eleventh floor.

It is apparent from the foregoing that with the concurrent method of construction according to this invention, the same construction activity takes place each day, at a different respective location, so that for buildings of moderate size (i.e., less than about 10,000 sq. ft. per floor) one story can be completed each day. Also, with this method a balanced and repetitive work load is achieved. This is extremely advantageous for scheduling, and enables optimum productivity to be achieved. In other words, with this invention, concrete workers, form carpenters, iron workers, electricians, and cement finishers can work continuously and without interruption each day, doing the same work the next day on a different story. This enables optimum scheduling of work load, and avoids the necessity of the practice, common with the standard method of construction, of ferrying the workers between two distant work sites to eliminate idle time for the workers, or requiring the workers to perform different jobs on different days.

Figure 1A:
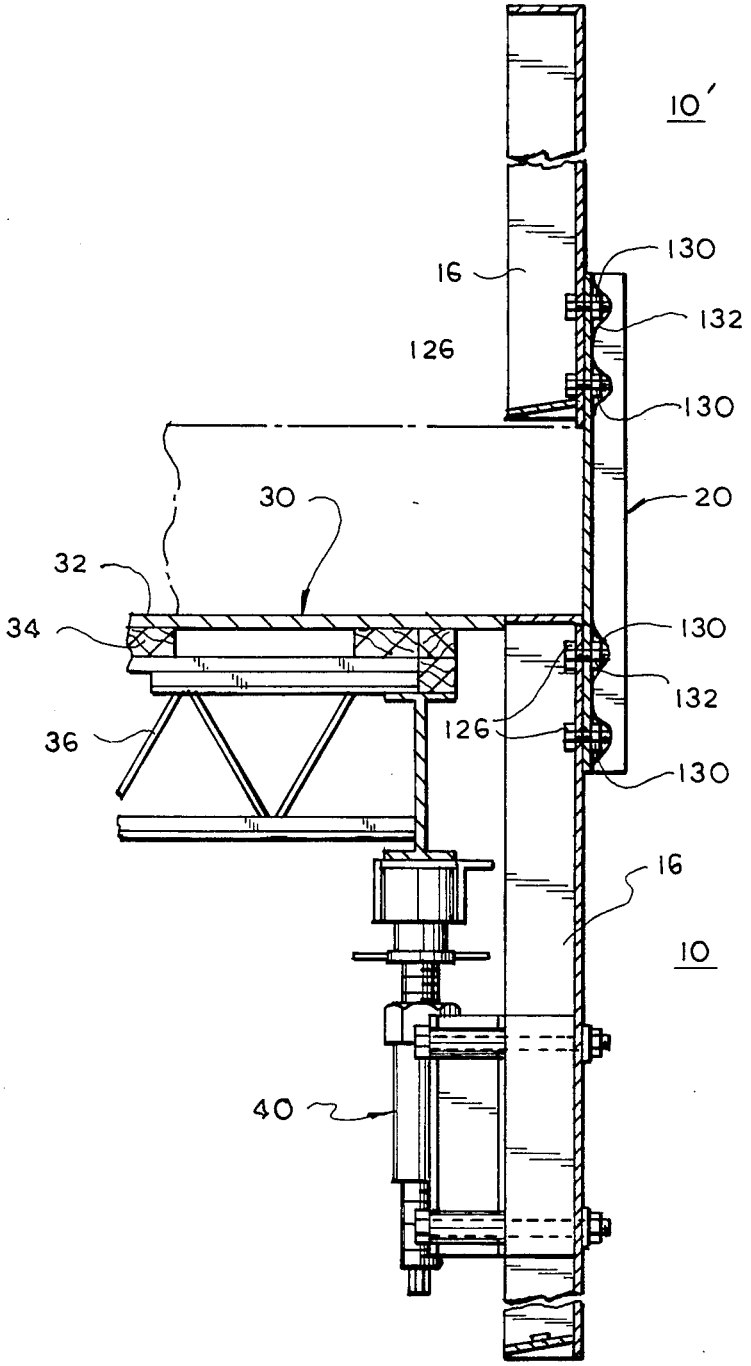
FIGS. 1A and 1B are elevational sections showing detail of formwork construction according to an embodiment of this invention.
Figure 1B:
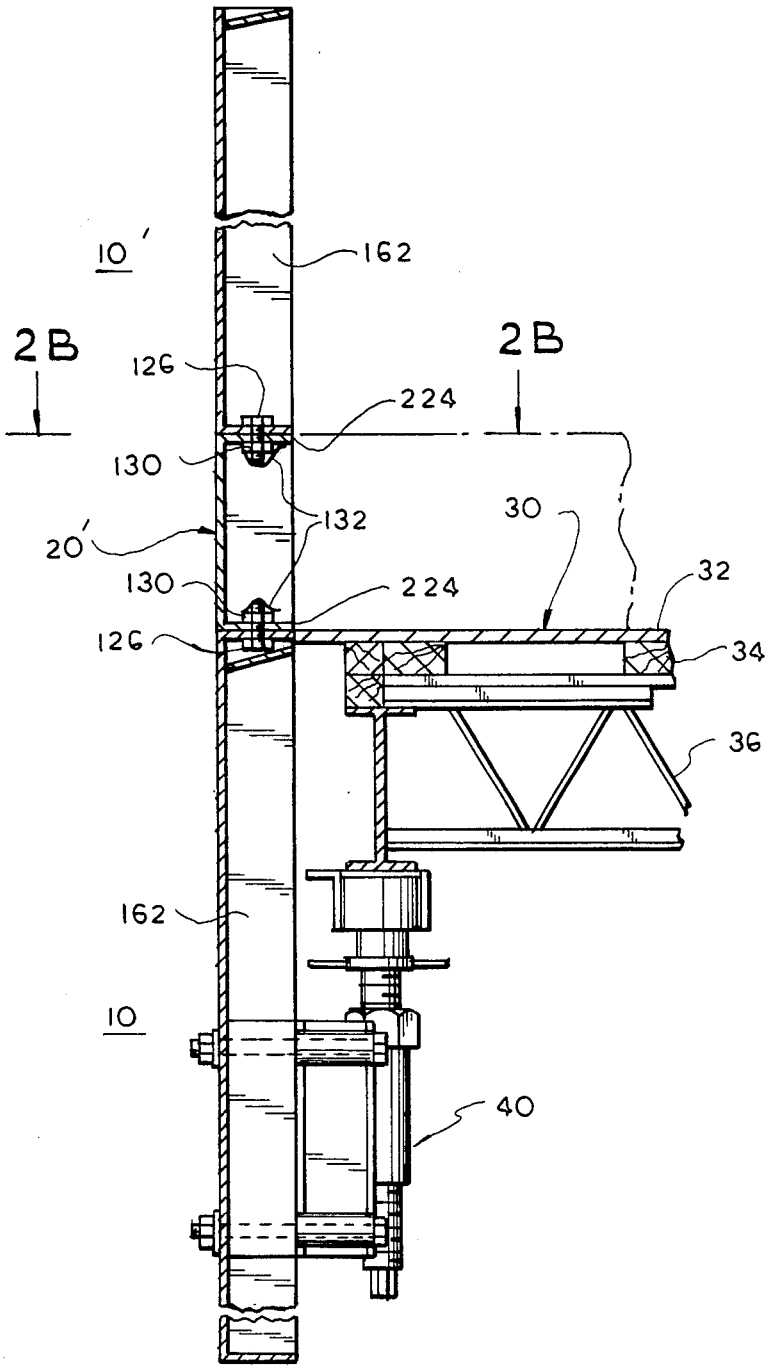
Figure 2A:
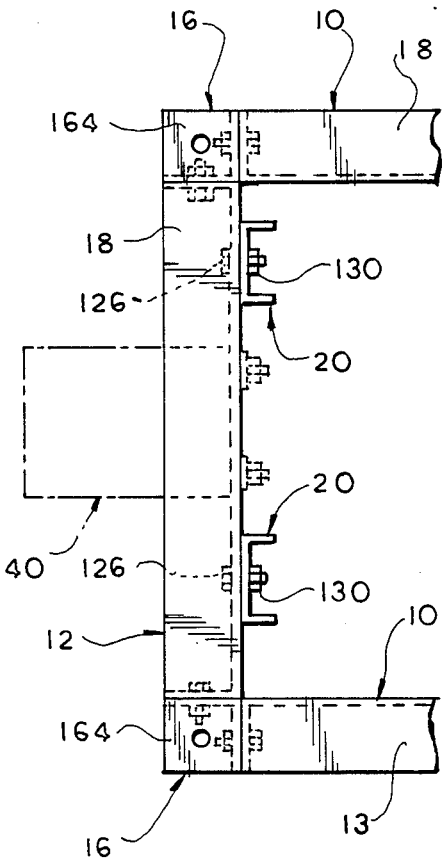
FIGS. 2A and 2B are partial plan views of the top of a column form arranged for carrying out the method of this invention.
Figure 2B:
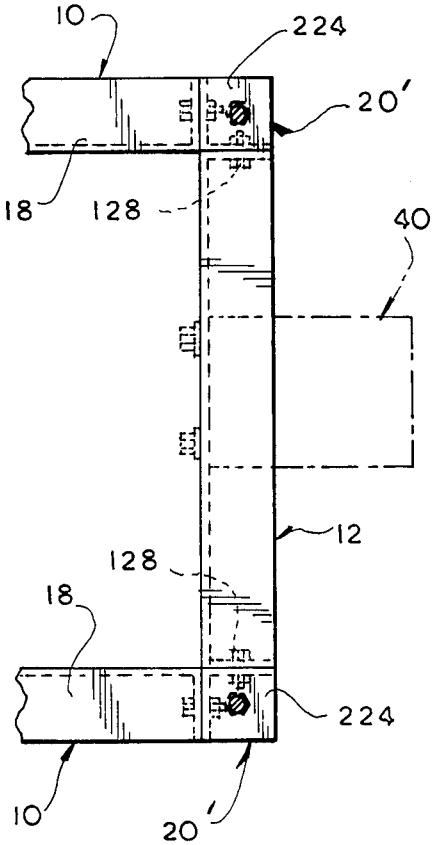

The structure of the building forms for carrying out construction according to this invention is illustrated in FIGS. 1A , 1B, 2A, 2B, and 3–5. These figures illustrate generally the novel structure of a typical column form 10 for use with the method of this invention and two alternative novel form spacers 20 (FIG. 1A , FIG. 2A, and FIG. 4) and 20′ (FIG. 1B, FIG. 2B, and FIG. 5) are shown. In FIGS. 2A and 2B these two types of spacers 20 and 20′ are shown side by side for illustrative purposes. However, in practice, only one or the other of these form spacers 20 and 20′ would be used.

Figure 3:
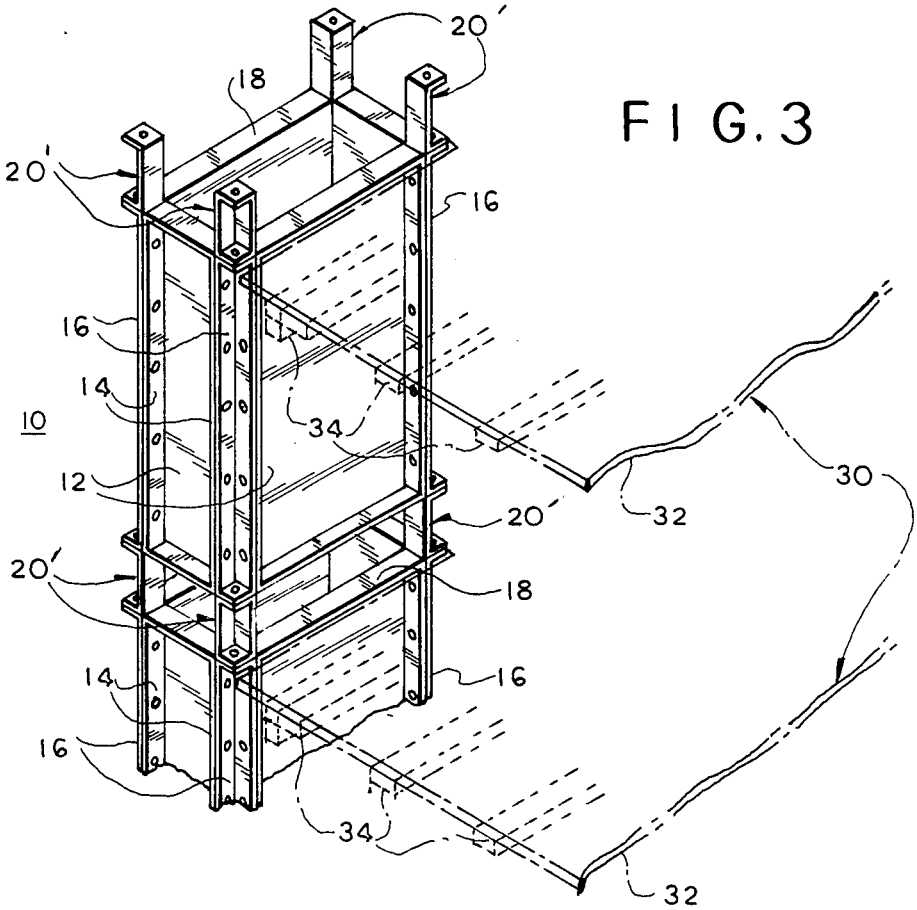
FIG. 3 is an illustrative schematic view showing the relative arrangement of column forms and decking forms according to an embodiment of this invention.
Figure 4:
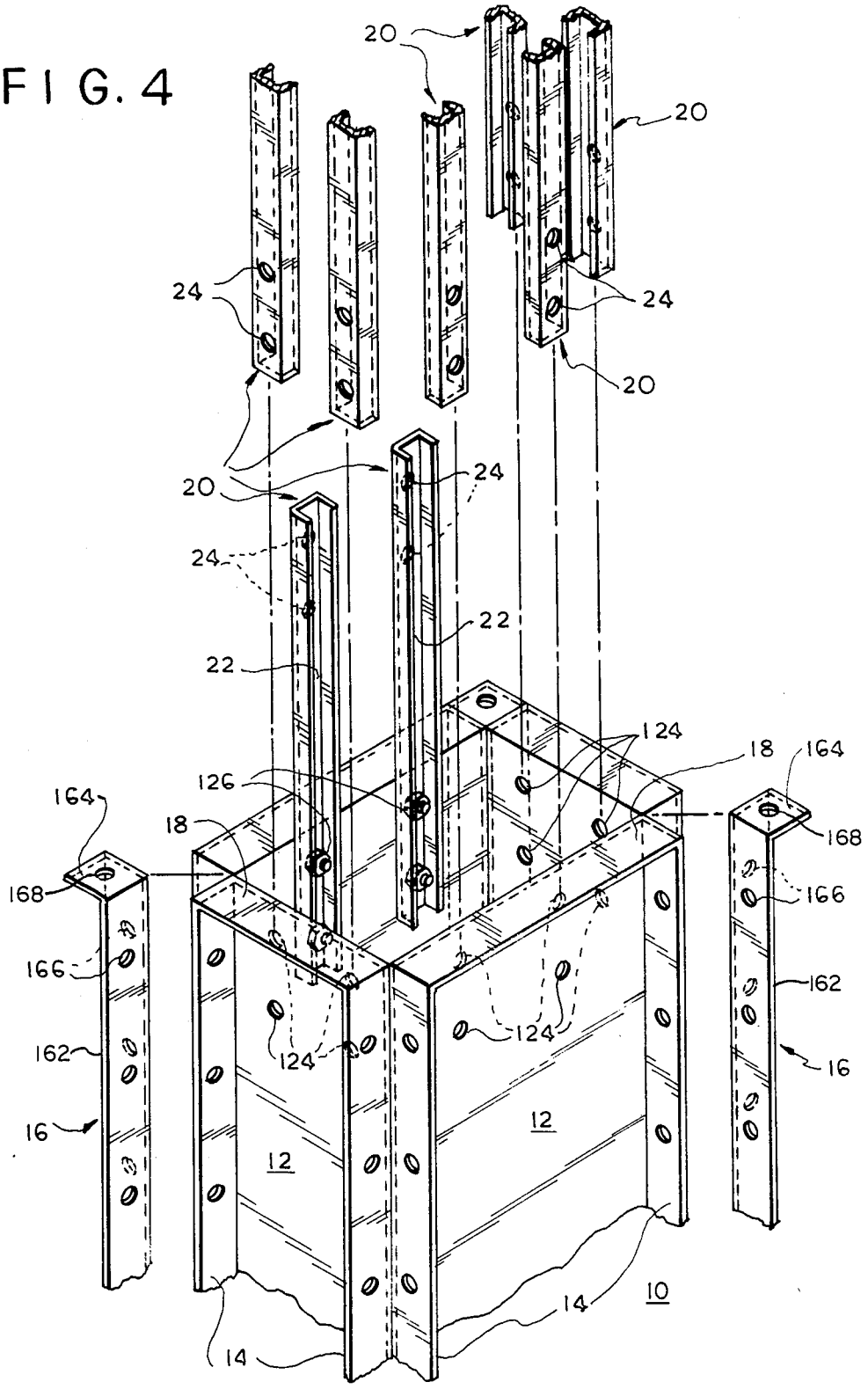
FIGS. 4 and 5 are perspective views illustrating the construction of column forms and vertical formwork spacers according to this invention.
Figure 5:
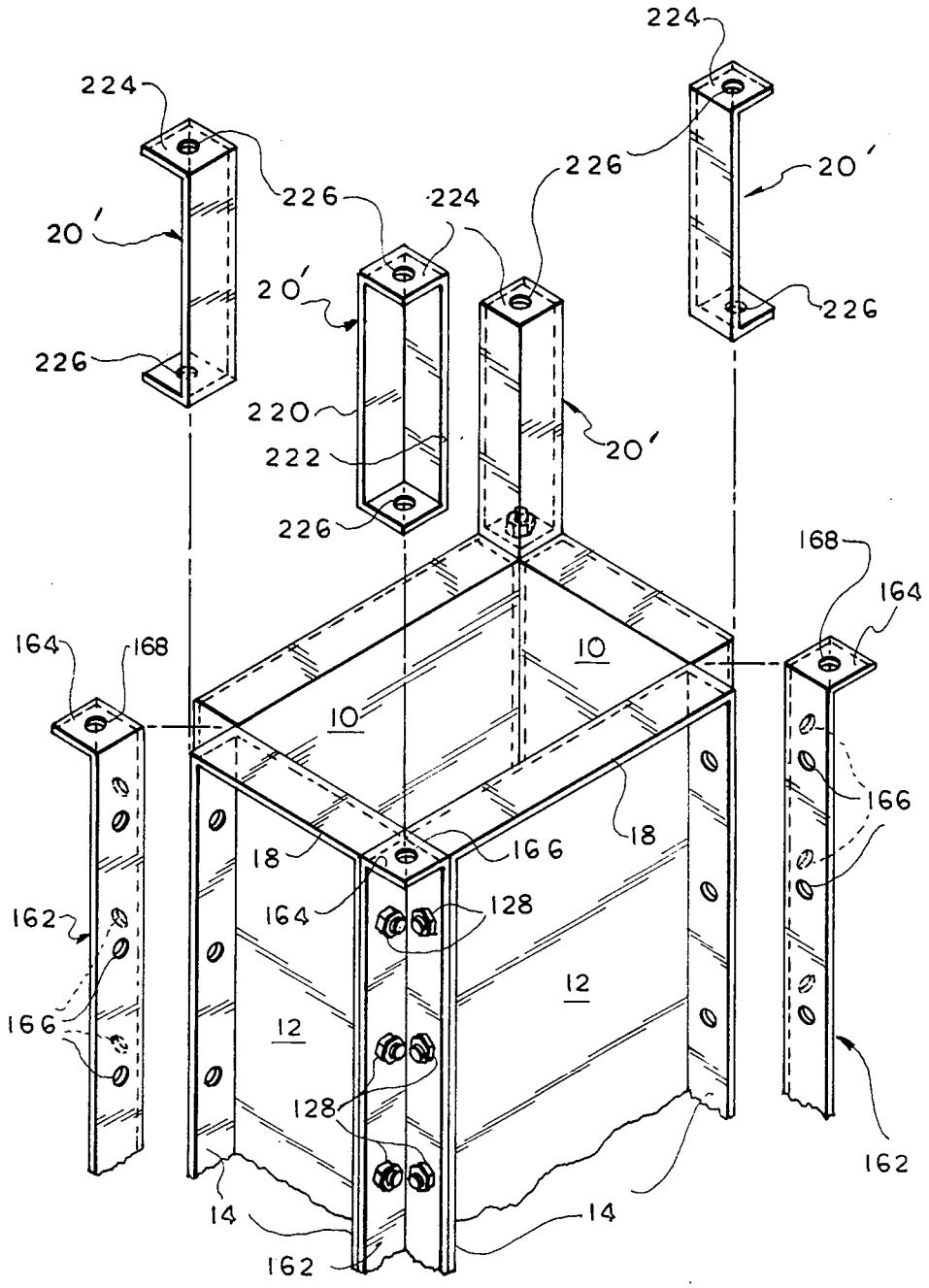

As shown, for example, in FIGS. 3, 4 and 5, column forms 10 are constructed of four flat panels 12, the four panels together enclosing a box-like structure into which fresh concrete is to be poured to constitute a column. The panels 12 each have vertical flanges 14 extending outward on longitudinal sides thereof. Corner braces 16, preferably formed as closed-end angle members, join the flanges 14 of adjacent panels 12. As best shown in FIGS. 4 and 5, these corner braces 16 are formed of vertical flanges 162 joined at a common edge with square horizontal end flanges 164 at the top and at the bottom thereof. These end flanges 164 each have a central bolt hole 168 therethrough while the vertical flanges 162 have flange bolt holes 166. spaced periodically along the length thereof for bolting the corner braces 16 to the flanges 14 of the panels 12.

Horizontal flanges 18 extend horizontally outward from the panels 12 at least at the top edges thereof.

The spacers 20 or 20′ are removably couplable to the top of each of the column forms 10 and extend upward through the thickness of a slab (yet to be poured) for mounting column forms 10′ for the story immediately thereabove.

One type of spacer 20 (FIGS. 1A and 4) can be formed of a channel member 22 having bolt holes 24 through the web thereof and spaced a predetermined distance apart corresponding to a predetermined slab thickness. These spacers are preferably fastened, two per panel 12, by means of bolts 126 passing through the spacer bolt holes 24 and through corresponding bolt holes 124 in the panels 12.

In the form spacers 20, the holes 24 at the top of the channel member 22 are separated from the holes 24 at the bottom thereof by a distance corresponding to the thickness of the desired slab, plus twice the distance from the corresponding holes 124 in the panels 12 to the top (or bottom) of the form 10 or 10′.

The other illustrated spacers 20′ are closed-end angle members having vertical flanges 220 and 222 forming a right angle at a common edge thereof and with horizontal, square end flanges 224 at the top and bottom thereof. These end flanges 224 have a central bolt hole 226 therethrough corresponding with the bolt hole 166 on the horizontal flanges 164 of the corner braces 16. In practice, four such spacers 20′ are disposed atop each column form 10, one at each corner brace 16 thereof, for mounting the corresponding corner braces 16 of the column form 10′ for the next story thereabove. These corner braces 16 and spacers 20′ can be easily secured by bolts 126.

Deck forms 30, shown schematically in FIGS. 1B and 3, are provided with a horizontal panel 32 extending along a plane level with the top of the corresponding column form 10, supported by the usual stringers 34 and joists 36. The deck forms 30 are preferably constructed as flying forms for ease of moving from one story to another. For that reason, it is preferred to support the deck forms 30 with a roller-type column bracket 40, of the type illustrated in FIG. 1B.

During the construction of the columns and slabs poured in the formwork illustrated, the form spacers 20 and 20′ are lost, i.e., the form spacers 20 and 20′ remain within the resulting column and/or slab when the corresponding formwork is stripped away therefrom. Thus, these form spacers 20 and 20′ are mounted by fastening the respective bolts 126 with nuts 130 on the concrete-side of the spacers 20 and 20′, and by protecting the threads of the bolts 126 with a waterproof tape 132, so that the bolt 126 can be easily withdrawn from the nut 132 when the poured concrete slab and column have been cured.

In addition to the column forms 10 and the column form spacers 20 and 20′, bearing wall forms and associated spacers would also be required for most types of building construction. However, many suitable wall forms are well known, and suitable wall form spacers could be substantially identical to the column form spacers 20 and 20′.

Further, although a substantially rectangular column form 10 has been illustrated and described herein, it should be apparent that the principles of this invention could also be applied to construction of buildings having round or oval columns, or having only bearing walls and no columns.

Figure 6:
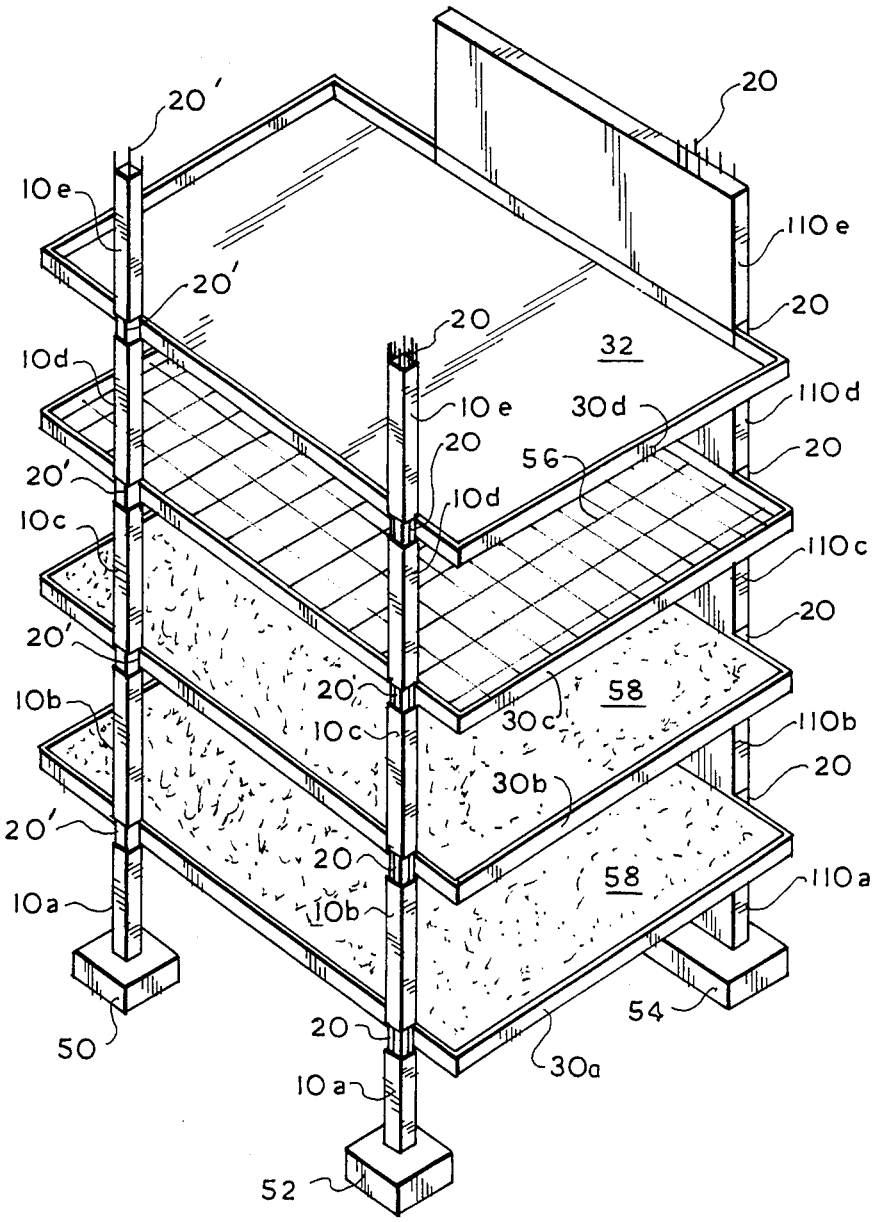
FIGS. 6 and 7 are schematic perspective views illustrating the construction of one portion of a multi-story building on two consecutive work days.
Figure 7:
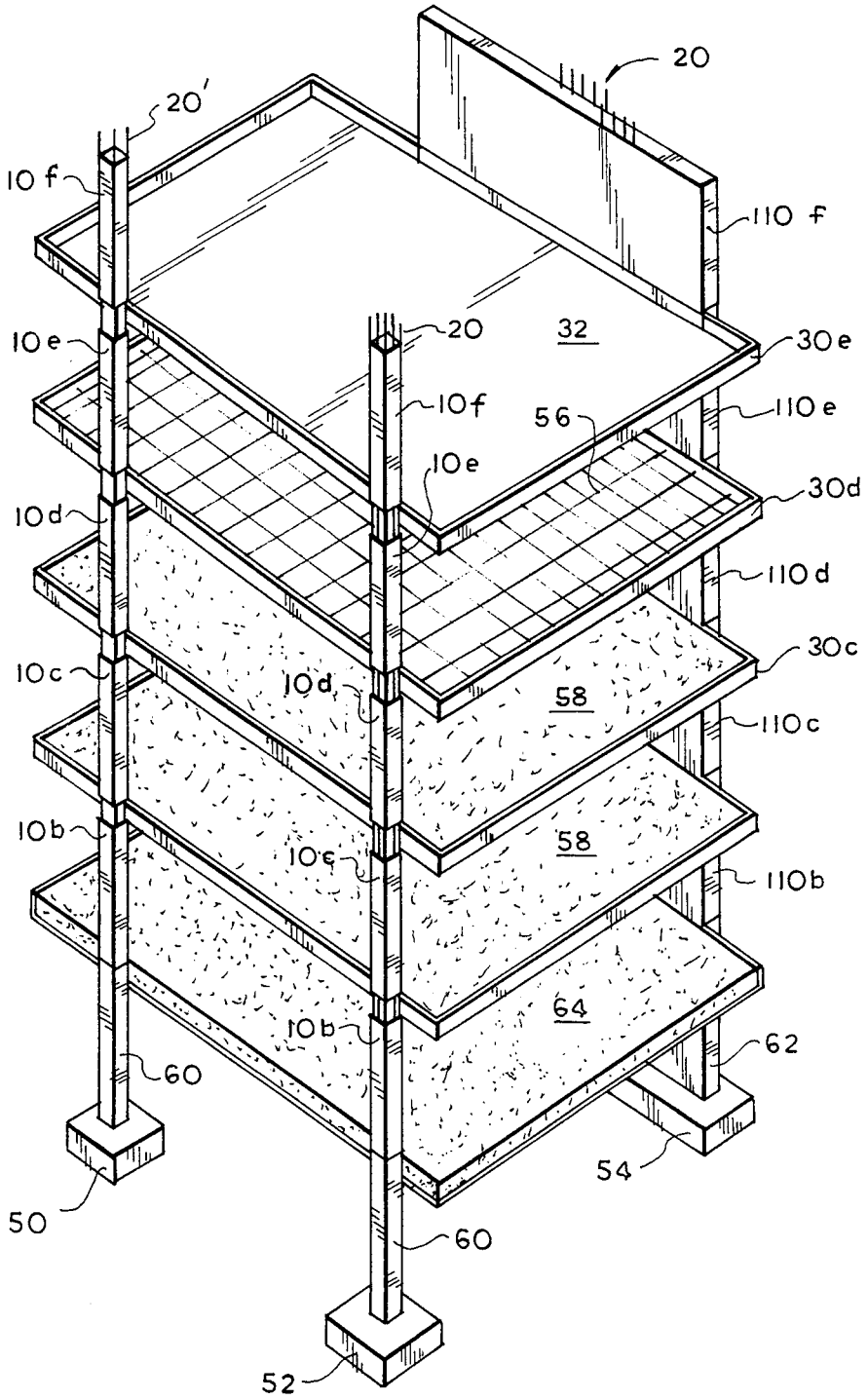

FIGS. 6 and 7 illustrate the sequential steps of the method of this invention applied to one bay of a building flanked by two columns on one side and a wall on the other. This bay represents only a segment of such a building, but it is to be understood that the operation for constructing all such bays for a given building would be identical and could proceed simultaneously. It should also be noted that the two columns and the wall are purely illustrative, and the vertical support structures could, of course, include any combination of columns and walls.

As illustrated in FIG. 6, in one possible embodiment of the method of this invention, column forms 10*a* and walls forms 110*a* extend upwardly from column foundations 50 and 52 and from a plate foundation 54 for the vertical bearing wall to a deck form 30*a* in which a deck or floor for the first story is to be formed. Column forms 10*b* and wall forms 110*b* are joined to the column forms 10*a* and wall forms 110*a* by spacers 20 or 20' and extend upwardly to the level of a second deck form 30*b* for forming the floor for a next story. Similar column forms 10*c*–10*e* and wall forms 110*c*–110*e* and corresponding successive deck forms 30*c* and 30*d* are provided in vertical alignment with the corresponding forms therebeneath. In this embodiment, the formwork for four successive stories of the bay are erected consecutively, so that the various steps required for the construction of the building bay can all be carried out concurrently. More specifically, on the same day that the forms 10*e* and 110*e* and the deck form 30*d* are erected, reinforcing steel 56 is installed in the deck form 30*c* therebelow and is also installed for the column forms 10*e* and the wall 110*e*. Concurrently therewith, fresh concrete 58 is poured into the deck form 30*b*, and into the column forms 10*c* and the wall form 110*c*. At this same time, the poured-in-place concrete 58, poured one working day earlier into the slab form 30*a* and into the column forms 10*b* and wall form 110*b*, is curing.

FIG. 7 shows the construction of the same building at the end of the next successive working day. Here, a deck form 30*e* has been installed one floor above the previous top deck form 30*d*. Column forms 10*f* and a wall form 110*f* have been erected, mounted on suitable form spacers 20 or 20' atop the column forms 110*e* and wall form 110*e* immediately therebeneath. Also on that same day, reinforcing steel 56 has been laid in place in the deck form 30*d* and for the columns 10*f* and the wall 110*f*, fresh concrete 58 has been poured into the deck form 30*c* and into the column forms 10*d* and the wall form 110*d*. The column forms 10*a*, the wall form 110*a*, and the deck form 30*a* have also been stripped at this time to yield resulting columns 60, a bearing wall 62 and a floor slab 64 for the first story.

It is apparent that with this method, the construction will progress upwardly at the rate of one story per day, with the same tasks being performed each day on a successively higher story.

The forms 10*a*, 110*a*, and 30*a* stripped from the finished first story structure would, in practice, be re-erected at the next required story (in this example, on the sixth story).

The number of slab forms required to be installed in vertical alignment at any one time depends upon the number of days required to cure the columns 60, walls 62, and slabs 64. In this embodiment, a two day cure is effected. However, if a three day cure were required, an additional set of forms 10, 110 and 30 could be easily installed.

While not shown in the drawings, in most high-rise poured-in-place structures, elevator and stairwell shafts can be constructed somewhat ahead of the general floor slab construction. This also could easily be carried out according to the method of this invention.

For buildings having a floor area in excess of about 10,000 sq. ft. per story, each floor can be constructed in two or more sections, thereby resulting in construction of one floor every two (or three) days. This is still a remarkable improvement over the standard method which yields, at best, one story every six days for buildings of 10,000 sq. ft. or more per story.

The following tables illustrate the progression of two tall poured-in-place cast concrete buildings, following the principles of this invention: the first building being constructed according to a one-day cycle; the other being constructed according to a two-day cycle, wherein the floors are formed in two stages, first a north half, then a south half.

TABLE 1

Typical One-Day Cycle

| | Floor | | | | | | | | | | | | |
|---|---|---|---|---|---|---|---|---|---|---|---|---|---|
| Day | 1 | 2 | 3 | 4 | 5 | 6 | 7 | 8 | 9 | 10 | 11 | 12 | 13 |
| 1 | | FC | | | | | | | | | | | |
| 2 | | FSa | FC | | | | | | | | | | |
| 3 | | R | FSb | FC | | | | | | | | | |
| 4 | | PC | R | FSc | FC | | | | | | | | |
| 5 | | PSa | PC | R | FSd | FC | | | | | | | |
| 6 | | C | PSb | PC | R | FSa | FC | | | | | | |
| 7 | | S | C | PSc | PC | R | FSb | FC | | | | | |
| 8 | | | S | C | PSb | PC | R | FSc | FC | | | | |
| 9 | | | | S | C | PSa | PC | R | FSd | FC | | | |
| 10' | | | | | S | C | PSb | PC | R | FSa | FC | | |
| 11 | | | | | | S | C | PSc | PC | R | FSb | FC | |
| 12 | | | | | | | S | C | PSd | PC | R | FSc | FC |
| 13 | | | | | | | | S | C | PSa | PC | R | FSd |
| 14 | | | | | | | | | S | C | PSb | PC | R |
| 15 | | | | | | | | | | S | C | PSc | PC |
| 16 | | | | | | | | | | | S | C | PSd |
| 17 | | | | | | | | | | | | S | C |
| 18 | | | | | | | | | | | | | S |

FC — Place column formwork

FSa to FSd — Place slab formwork for cycles of floors a, b, c, d, . . .

R — Place reinforcing steel

PC — Pour columns

PSa to PSd — Pour slabs for cycles of floors a, b, c, d . . .

C — Cure

S — Strip formwork

TABLE 2

Typical Two-day Cycle
Floors formed in two stages:
First North half, then South half

| Day | Floor 3N | 3S | 4N | 4S | 5N | 5S | 6N | 6S | 7N | 7S . . . | 26S |
|---|---|---|---|---|---|---|---|---|---|---|---|
| 1 | FS | | | | | | | | | | |
| 2 | FC | FS | | | | | | | | | |
| 3 | R | FC | FS | | | | | | | | |
| 4 | PC | R | FC | FS | | | | | | | |
| 5 | PS | PC | R | FC | FS | | | | | | |
| 6 | C | PS | PC | R | FC | FS | | | | | |
| 7 | S | C | PS | PC | R | FC | FS | | | | |
| 8 | | S | C | PS | PC | R | FC | FS | | | |
| 9 | | | S | C | PS | PC | R | FC | FS | | |
| 10 | | | | S | C | PS | PC | R | FC | FS | |
| 11 | | | | | S | C | PS | PC | R | FC | |
| 12 | | | | | | S | C | PS | PC | R | |
| 13 | | | | | | | S | C | PS | PC | |
| 14 | | | | | | | | S | C | PS | |
| 15 | | | | | | | | | S | C | |
| 16 | | | | | | | | | | S | |
| 17 | | | | | | | | | | | etc. |

FC — Place column formwork
FS — Place slab formwork
R — Place reinforcing steel
PC — Pour columns
PS — Pour slabs
C — Cure
S — Strip formwork Table 3 is an illustrative comparison of the daily construction activities required to construct an eight-story building. As is apparent from Table 3, while 49 days are required to construct the building accordingly to the standard or conventional method, the same building can be erected in only approximately 12 days if the techniques of this invention are practiced, with the final form stripping being completed in only about 2 days thereafter.

TABLE 3

One-day Cycle

| Operation, Standard Procedure Sequence | Standard Procedure Work Day # | Concurrent Method Work Day # |
|---|---|---|
| Complete foundation | 1 | 1 |
| Place vertical reinforcing steel to 2nd floor | 2 | 2 |
| Erect vertical forms to 2nd floor | 2 | 2 |
| Pour concrete to 2nd floor | 3 | 4 |
| Strip vertical forms to 2nd floor | 4 | 7 |
| Erect slab form on 2nd floor | 5 | 3 |
| Place bottom reinforcing steel, 2nd floor | 6 | 4 |
| Place top reinforcing steel, conduit, 2nd floor | 6 | 4 |
| Pour concrete slab, 2nd floor | 7 | 5 |
| Place reinforcing steel to 3rd floor | 8 | 3 |
| Erect vertical forms to 3rd floor | 8 | 3 |
| Pour concrete to 3rd floor | 9 | 5 |
| Strip vertical forms to 3rd floor | 10 | 8 |
| Erect slab form, 3rd floor | 11 | 4 |
| Place bottom reinforcing steel, 3rd floor | 12 | 5 |
| Place top reinforcing steel, conduit, 3rd floor | 12 | 5 |
| Pour slab, 3rd floor | 13 | 6 |
| Place vertical reinforcing steel to 4th floor | 14 | 4 |
| Erect vertical forms to 4th floor | 14 | 4 |
| Pour concrete to 4th floor | 15 | 6 |
| Strip vertical forms to 4th floor | 16 | 9 |
| Erect slab form, 4th floor | 17 | 5 |
| Place bottom reinforcing steel, 4th floor | 18 | 6 |
| Place top reinforcing steel, conduit, 4th floor | 18 | 6 |
| Pour slabs, 4th floor | 19 | 7 |
| Place vertical reinforcing steel, to 5th floor | 20 | 5 |

TABLE 3-continued

One-day Cycle

| Operation, Standard Procedure Sequence | Standard Procedure Work Day # | Concurrent Method Work Day # |
|---|---|---|
| Erect vertical forms to 5th floor | 20 | 5 |
| Pour concrete to 5th floor | 21 | 7 |
| Strip vertical forms to 5th floor | 22 | 10* |
| Erect slab form, 5th floor | 23 | 6 |
| Place bottom reinforcing steel, 5th floor | 24 | 7 |
| Place top reinforcing steel, conduit, 5th floor | 24 | 7 |
| Pour slab, 5th floor | 25 | 8 |
| Place vertical reinforcing steel to 6th floor | 26 | 6 |
| Erect vertical forms to 6th floor | 26 | 6* |
| Pour concrete to 6th floor | 27 | 8 |
| Strip vertical forms to 6th floor | 28 | 11 |
| Erect slab form, 6th floor | 29 | 7 |
| Place bottom reinforcing steel, 6th floor | 30 | 8 |
| Place top reinforcing steel, conduit, 6th floor | 30 | 8 |
| Pour slab, 6th floor | 31 | 9 |
| Place vertical reinforcing steel to 7th floor | 32 | 7 |
| Erect vertical forms to 7th floor | 32 | 7 |
| Pour concrete to 7th floor | 33 | 9 |
| Strip vertical forms to 7th floor | 34 | 12* |
| Erect slab form, 7th floor | 35 | 8 |
| Place bottom reinforcing steel, 7th floor | 36 | 9 |
| Place top reinforcing steel, conduit, 7th floor | 36 | 9 |
| Pour slab, 7th floor | 37 | 10 |
| Place vertical reinforcing steel to 8th floor | 38 | 8 |
| Erect vertical forms to 8th floor | 38 | 8 |
| Pour concrete to 8th floor | 39 | 10 |
| Strip vertical forms to 8th floor | 40 | 13* |
| Erect slab form 8th floor | 41 | 9 |
| Place bottom reinforcing steel, 8th floor | 42 | 10 |
| Place top reinforcing steel, conduit, 8th floor | 42 | 10 |
| Pour slab, 8th floor | 43 | 11 |
| Place vertical reinforcing steel to roof | 44 | 9 |
| Erect vertical forms to roof | 44 | 9 |
| Pour concrete to roof | 45 | 11 |
| Strip vertical forms to roof | 46 | 14* |
| Erect slab form, roof | 47 | 10 |

TABLE 3-continued

| One-day Cycle | | |
|---|---|---|
| Operation, Standard Procedure Sequence | Standard Procedure Work Day # | Concurrent Method Work Day # |
| Place bottom reinforcing steel, roof | 48 | 11 |
| Place top reinforcing steel, conduit, roof | 48 | 11 |
| Pour roof | 49 | 12 |

*As Desired - Not Reused

The following Table 4 is a comparison of the construction of a building on a two-day cycle using the standard procedure and using the concurrent method of this invention.

TABLE 4

| Two-day Cycle | | |
|---|---|---|
| Operation, Standard Procedure Sequence | Standard Procedure Work Day # | Concurrent Method Work Day # |
| Complete foundation | 1 | 1 |
| Place vertical reinforcing steel to 2nd floor | 2 | 2 |
| Erect vertical forms to 2nd floor | 2 | 2 |
| Pour concrete to 2nd floor | 3 | 5 |
| Strip vertical forms to 2nd floor | 4 | 9 |
| Erect slab form, 2nd floor | 5 | 3 |
| Place bottom reinforcing steel, 2nd floor | 6 | 4 |
| Place top reinforcing steel, conduit, 2nd floor | 7 | 5 |
| Pour slabs, 2nd floor | 8 | 6 |
| Place vertical steel to 3rd floor | 9 | 4 |
| Erect vertical forms to 3rd floor | 9 | 4 |
| Pour concrete to 3rd floor | 10 | 7 |
| Strip vertical form to 3rd floor | 11 | 11 |
| Erect slab form, 3rd floor | 12 | 5 |
| Place bottom reinforcing steel, 3rd floor | 13 | 6 |
| Place top reinforcing steel, conduit, 3rd floor | 14 | 7 |
| Pour slab, 3rd floor | 15 | 8 |
| Place vertical reinforcing steel to 4th floor | 16 | 6 |
| Erect vertical forms to 4th floor | 16 | 6 |
| Pour concrete to 4th floor | 17 | 9 |
| Strip vertical forms to 4th floor | 18 | 13 |
| Erect slab form, 4th floor | 19 | 7 |
| Place bottom reinforcing steel, 4th floor | 20 | 8 |
| Place top reinforcing steel, conduit, 4th floor | 21 | 9 |
| Pour slab, 4th floor | 22 | 10 |
| Place vertical reinforcing steel to 5th floor | 23 | 8 |
| Erect vertical forms to 5th floor | 23 | 8 |
| Pour concrete to 4th floor | 24 | 11 |
| Strip vertical forms to 5th floor | 25 | 15 |
| Erect slab form, 5th floor | 26 | 9 |
| Place bottom reinforcing steel, 5th floor | 27 | 10 |
| Place top reinforcing steel, conduit, 5th floor | 28 | 11 |
| Pour slab, 5th floor | 29 | 12 |
| Place vertical reinforcing steel to 6th floor | 30 | 10 |
| Erect vertical forms to 6th floor | 30 | 10 |
| Pour concrete to 6th floor | 31 | 13 |
| Strip vertical forms to 6th floor | 32 | 17* |
| Erect slab form, 6th floor | 33 | 11 |
| Place bottom reinforcing steel, 6th floor | 34 | 12 |
| Place top reinforcing steel, conduit, 6th floor | 35 | 13 |
| Pour slab, 6th floor | 36 | 14 |
| Place vertical reinforcing steel to 7th floor | 37 | 12 |
| Erect vertical forms to 7th floor | 37 | 12 |
| Pour concrete to 7th floor | 38 | 15 |
| Strip vertical forms to 7th floor | 39 | * |
| Erect slab form, 7th floor | 40 | 13 |
| Place bottom reinforcing steel, 7th floor | 41 | 14 |

TABLE 4-continued

| Two-day Cycle | | |
|---|---|---|
| Operation, Standard Procedure Sequence | Standard Procedure Work Day # | Concurrent Method Work Day # |
| Place top reinforcing steel, conduit, 7th floor | 42 | 15 |
| Pour slab, 7th floor | 43 | 16 |
| Place vertical reinforcing steel to 8th floor | 44 | 14 |
| Erect vertical forms to 8th floor | 44 | 14 |
| Pour concrete to 8th floor | 45 | 17 |
| Strip vertical forms to 8th floor | 46 | * |
| Erect slab form, 8th floor | 47 | 15 |
| Place bottom reinforcing steel, 8th floor | 48 | 16 |
| Place top reinforcing steel, conduit, 8th floor | 49 | 17 |
| Pour slab, 8th floor | 50 | 18 |
| Place vertical reinforcing steel to roof | 51 | 16 |
| Erect vertical forms to roof | 51 | 16 |
| Pour concrete to roof | 52 | 19 |
| Strip vertical forms to roof | 53 | * |
| Erect slab form, roof | 54 | 17 |
| Place bottom reinforcing steel, roof | 55 | 18 |
| Place top reinforcing steel, conduit, roof | 56 | 19 |
| Pour roof | 57 | 20 |

*As Desired - Not Reused

Construction of an eight-story building, which requires 57 days using the standard procedure is constructed in only 20 days using the concurrent method of this invention.

From a comparison of the standard and concurrent methods using the above tables 3 and 4, it should be noted that none of the steps of the standard procedure are omitted, but in most cases, several of the steps are carried on concurrently whereas in the standard procedure, the steps are generally carried out on different days.

As pointed out previously, with this invention, a great amount of time waste is prevented, such as waiting time for iron workers, concrete finishers, and other workmen, and, in addition, the building itself can be completed in a much shorter total span of time.

The foregoing have been provided only as examples of how this invention might be carried out, and many possible variations thereof will be apparent to persons skilled in the art.

For example, although the spacers 20 and 20' will normally remain in the finished concrete slab 64 or in the finished columns 60 or wall 62, if architectural considerations so dictate, the spacer can be surrounded by a sleeve, and then removed from the finished concrete structure. However, the spacers 20 and 20' themselves are inexpensive items and it is not economically necessary to save the spacers otherwise.

Furthermore, spacers suitable for use in the present invention need not have the precise forms of the spacers 20 and 20' respectively illustrated in FIGS. 4 and 5 above. Indeed, the spacer need only meet the criteria of being strong enough to support the forms 10 and 110 mounted thereabove, and to provide mounting structure for the column and wall forms 10 and 110.

Figure 8:
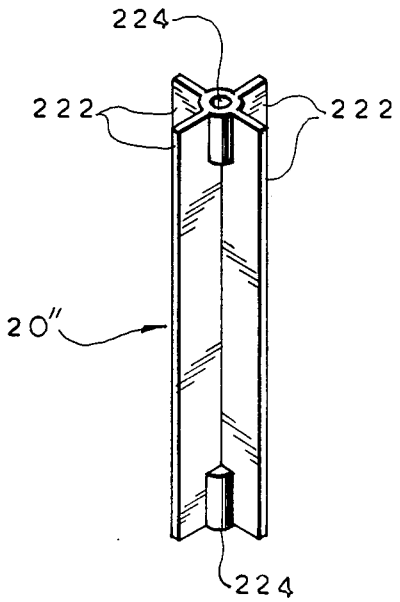
FIG. 8 illustrates one possible alternative of the formwork spacer for carrying out the method of this invention.

One possible alternative structure of a spacer 20'' is illustrated in FIG. 8. Here the spacer is formed of four vertical flanges 222 joined together to form an X in cross-section, and having a threaded socket 224 at either end thereof. The spacer 20'' can easily be substituted, for example, for the spacer 20'.

Further, while the building constructed as shown in FIGS. 6 and 7 has columns in vertical alignment on one side of the bay while walls are in vertical alignment on the other, this invention could also be carried out in constructing a building in which bearing walls are erected on every other story in substantial vertical alignment with columns on the alternating stories.

Many further modifications and variations of this invention will be apparent to those skilled in the art without any departure from the scope or spirit of this invention, as defined in the appended claims.

I claim:

1. A method of constructing a multi-story building made of poured-in-place concrete, in which each story thereof has a concrete slab constituting a floor thereof and vertical support members supporting a concrete slab constituting the floor for the next story thereabove, with the vertical support members for each said story being substantially in vertical alignment with corresponding vertical support members of the next story therebeneath, comprising erecting vertical formwork members for the vertical support members for one said story;

erecting decking formwork for the concrete slab of the next story thereabove;

affixing formwork spacers to the top of said vertical formwork members, said spacers providing mounts extending through the thickness of the slab to be formed in said decking formwork for mounting vertical formwork members for the next story;

erecting said vertical formwork members for said next story;

pouring fresh concrete at least into said vertical formwork members of said one story to solidify into said vertical support members;

curing said vertical support members;

pouring and curing said slabs and vertical support members for at least the next story thereabove; and stripping said vertical formwork members from said vertical support members and said decking formwork from said concrete slabs.

2. A method of constructing a multi-story building made of poured-in-place concrete, in which each story thereof has a concrete slab forming a floor thereof and vertical support members supporting a concrete slab forming the floor for the next story thereabove, with the vertical support members for each said story being substantially in vertical alignment with corresponding vertical support members of the next story therebeneath, comprising erecting vertical formwork members for the vertical support members for one said story;

erecting decking formwork for the concrete slab of the next story thereabove;

affixing formwork spacers to the top of said vertical formwork members, said spacers providing mounts extending through the thickness of the slab to be formed in said decking formwork for mounting vertical formwork members for another story immediately above said next story;

laying in reinforcing members for the decking formwork so erected;

providing reinforcing members for the vertical support members for said other story above said next story;

erecting vertical and decking formwork for at least one further story above said other story, together with said formwork spacers separating the vertical formwork members for successive such stories;

pouring fresh concrete at least into said vertical formwork members of said one story to solidify into said vertical support members for said one story;

curing said vertical support members;

pouring and curing said slabs and vertical support members for the stories thereabove; and stripping said vertical formwork members from said vertical concrete support members and said decking formwork from said concrete slabs;

wherein formwork members are installed on a plurality of successive stories such that at one given time, for said plurality of successive stories, the formwork is stripped from the vertical concrete support members for a lowest story thereof, the concrete is poured for the next story thereabove, the reinforcing members are laid in for a story above said next story, and said formwork members are erected for another story two stories above said next story; and the steps of said method of constructing are carried out concurrently.

3. A method of constructing a multi-story building according to either claim 1 or claim 2; wherein said formwork spacers are formed as channel members having mounting apertures therein a predetermined distance apart.

4. A method of constructing a multi-story building according to either claim 1 or claim 2; wherein said formwork spacers are formed as angle members including vertical flange members joined to one another along one edge thereof and having a top and bottom spaced a predetermined distance apart, and attaching means disposed at said top and bottom, respectively, to which the bottom and top of the vertical formwork members for successive stories can be respectively affixed.

5. A method of constructing a multi-story building according to claim 4; wherein said vertical flanges are joined at a right angle and said attaching means include corresponding horizontal square flanges.

6. A method of constructing a multi-story building made of concrete poured in place, in which each story thereof has a concrete slab constituting a floor thereof and vertical columns supporting a concrete slab constituting the floor for the next story thereabove, with the columns for each story being in vertical alignment with the corresponding columns of the next story therebeneath, comprising erecting column formwork members for one story;

erecting decking formwork for the concrete slab of the next story thereabove;

affixing formwork spacers to the top of said column formwork members, said spacers providing mounts extending through the thickness of the slab to be formed in said decking formwork, for mounting column formwork members for the next story;

erecting said column formwork members for the next story and mounting the same on said formwork spacers;

pouring fresh concrete at least into said column formwork members of said one story to solidify into said vertical columns;

curing said columns;

pouring and curing said slabs and columns for at least the next story thereabove; and stripping said column formwork members from the cured columns and the decking formwork from the cured concrete slabs.

7. A method of constructing a multi-story building according to claim 6; further comprising affixing further such formwork spacers atop the column formwork members of said next story; and erecting on said further such formwork spacers the column formwork members stripped from the cured columns of a previous story below.

8. A method of constructing a multi-story building according to claim 6; wherein said column formwork members are erected by placing together an array of panels together forming a box, each said panel having vertical edges and a pair of flanges along vertical edge extending at right angles to said panel and outwardly with respect to said box; and joining the array of panels together with a plurality of angle pieces each formed of a pair of vertical flanges fused together along one edge thereof, with each said flange of each angle piece being removably affixed to a corresponding flange of one said panel.

9. A method of constructing a multi-story building according to claim 8; wherein said panels are provided with apertures near top and bottom ends thereof at a predetermined spacing respectively therefrom; and said formwork spacers are channel members having mounting apertures therein a predetermined distance apart corresponding to the thickness of the desired slab plus twice the predetermined spacing from the apertures in said panel to the respective ends thereof; and said affixing the formwork spacers includes applying removable connecting means through said apertures in the panels and through the associated mounting apertures in said channel members.

10. A method of constructing a multi-story building according to claim 9; wherein said channel members are mounted on the inside of said box so as to be contained within the concrete columns and any slab formed therebetween, when said column formwork is stripped from said columns.

11. A method of constructing a multi-story building according to claim 8; wherein said angle pieces each have horizontal flanges closing off top and bottom ends thereof; and said formwork spacers are each formed as closed-end angle members including vertical flange members joined to one another along one edge thereof and having a top and bottom spaced apart a predetermined distance corresponding to the thickness of the associated slab and horizontal flanges disposed at said top and bottom; said affixing the column formwork members being carried out by detachably mounting said horizontal flanges of said angle members to respective horizontal flanges of the angle pieces of the column formwork for an associated column.

12. A method of constructing a multi-story building according to claim 11; wherein said horizontal flanges of said angle pieces and of said angle members each have a central aperture therethrough; and said affixing is carried out by placing bolts through associated apertures of said angle pieces and angle members.

13. A method of constructing a multi-story building according to claim 8; wherein said angle pieces have horizontal flanges closing off top and bottom ends thereof; and said formwork spacers include a plurality of vertical flanges joined along a common edge and having a top and bottom spaced a predetermined distance apart corresponding to the thickness of the associated slab; and attaching means disposed at said top and bottom for detachably mounting said formwork spacers to the horizontal flanges of the angle pieces of the formwork for a column of one story and an associated structural member in vertical alignment therewith in the story next thereabove.

14. Formwork structure for use in construction of a multi-story building made of poured-in-place concrete and in which each of various steps of construction can be carried out concurrently on successively arranged stories thereof, each such story having a concrete slab constituting a floor thereof and vertical support members supporting a concrete slab constituting the floor for the next story thereabove, with the vertical support members for each said story being substantially in vertical alignment with corresponding vertical support members of the next story therebeneath, comprising vertical formwork members defining spaces into which fresh concrete can be poured to form said vertical support members for one such story, each said formwork member extending from a position corresponding to an upper surface of one slab to a position corresponding to a lower surface of the corresponding slab for the next story thereabove, the formwork members being strippable from the vertical support members formed therewithin for reuse in forming similar such support members;

vertical formwork spacers removably affixed to the top of said vertical formwork members of each of a plurality of stories and extending through the thickness of the slab to be formed for the next story thereabove and constituting mounts upon which the vertical formwork members for the next story are supported; and horizontal decking formwork means in which the concrete slabs for each of said plurality of stories are formed in place, such means being strippable from the associated slabs when the later have been formed and cured;

with said vertical formwork members, said formwork spacers, and said horizontal decking formwork means for said plurality of said stories being erected and supported only by their own structure, before concrete support members in the vertical formwork members for the lowermost of said plurality of stories have cured sufficiently to support structural stresses.

15. Formwork structure according to claim 14, wherein said plurality of stories is at least four stories, so that while poured-in-place concrete support members are curing in the formwork members of lowermost story; fresh concrete can be poured into the formwork members of the next story thereabove; reinforcing elements can be laid in for the story two stories above the lowermost story; and the formwork members for the uppermost story can be mounted in place on the formwork spacers extending upward from the top of the formwork spacers of the story immediately therebeneath.

* * * * *